US008752592B2

(12) United States Patent
Sutton et al.

(10) Patent No.: US 8,752,592 B2
(45) **Date of Patent: *Jun. 17, 2014**

(54) METHOD FOR MANUFACTURING A TURF REINFORCEMENT MAT

(71) Applicant: Lumite, Inc., Alto, GA (US)

(72) Inventors: Alan Sutton, Gainseville, GA (US); Rebecca Page, Flowery Branch, GA (US); George Miles Gibby, Cornelia, GA (US)

(73) Assignee: Lumite, Inc., Alto, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/693,574

(22) Filed: Dec. 4, 2012

(65) Prior Publication Data

US 2013/0092281 A1 Apr. 18, 2013

Related U.S. Application Data

(63) Continuation-in-part of application No. 12/845,234, filed on Jul. 28, 2010, now Pat. No. 8,342,213.

(60) Provisional application No. 61/229,962, filed on Jul. 30, 2009.

(51) Int. Cl.

| | |
|---|---|
| ***D03D 3/08*** | (2006.01) |
| ***D03D 11/02*** | (2006.01) |
| ***D03D 27/00*** | (2006.01) |
| ***E01C 13/08*** | (2006.01) |
| ***A41G 1/00*** | (2006.01) |
| *D03D 41/00* | (2006.01) |
| *D03D 25/00* | (2006.01) |
| *A41G 1/02* | (2006.01) |

(52) U.S. Cl.

CPC ..... *D03D 27/00* (2013.01); *E01C 13/08* (2013.01); *A41G 1/009* (2013.01); *D10B 2505/202* (2013.01); *A41G 1/02* (2013.01)

USPC ..... 139/384 R; 139/304; 139/309; 139/11

(58) Field of Classification Search

CPC ..... D05C 17/023; D05C 15/12; D05C 15/08; D05C 15/34; D05C 17/026; D05C 17/02; D04H 11/00; D04H 11/08; D04H 3/14; D03D 15/00; D03D 27/00; D03D 39/16; D03D 39/18; D03D 25/00; D03D 11/00; D03D 15/04; D03D 25/005; D03D 41/004; D03D 13/00; D03D 41/00; E01C 13/08; E01C 2013/086; E01C 2201/167; A63B 69/3661; A63B 69/3691; D06N 7/0036; D06N 7/006; D06N 7/0065; D10B 2505/202; A41G 1/009; A41G 1/02; Y10S 273/13; Y10S 139/01; Y10S 428/902; Y10S 264/81

USPC ..... 139/11, 304–316, 383 R, 384 R, DIG. 1

See application file for complete search history.

(56) References Cited

U.S. PATENT DOCUMENTS 2,757,434 A * 8/1956 McCord et al. ..... 28/156
3,047,444 A * 7/1962 Harwood ..... 428/153

(Continued)

FOREIGN PATENT DOCUMENTS

WO 2007067833 A2 6/2007

*Primary Examiner* — Bobby Muromoto, Jr.

(74) *Attorney, Agent, or Firm* — Gardner Groff Greenwald & Villanueva, PC

(57) ABSTRACT

A turf reinforcement fabric and a method for producing such a fabric by weaving a plurality of filaments in a predetermined pattern to form a three-dimensional structure formed to have a loft thickness without the application of heat to heat shrink the fibers, and/or formed with one or more fibers of increased thickness at peaks and valleys of the woven structure, and/or incorporating flame retardant and/or UV stabilizing fiber additives.

22 Claims, 7 Drawing Sheets

(56) References Cited

U.S. PATENT DOCUMENTS

| | | | | | |
|---|---|---|---|---|---|
| 3,279,221 | A * | 10/1966 | Gliksmann | 66/192 |
| 3,696,623 | A * | 10/1972 | Heine et al. | 405/19 |
| 4,002,034 | A * | 1/1977 | Muhring et al. | 405/19 |
| 4,183,993 | A * | 1/1980 | Benstead et al. | 442/314 |
| 4,421,439 | A * | 12/1983 | ter Burg et al. | 405/302.7 |
| 4,472,086 | A * | 9/1984 | Leach | 405/302.7 |
| 4,619,120 | A * | 10/1986 | Markowitz | 66/192 |
| 4,790,691 | A * | 12/1988 | Freed | 405/263 |
| 4,837,387 | A * | 6/1989 | van de Pol | 442/185 |
| 4,957,390 | A * | 9/1990 | Shoesmith | 404/70 |
| 4,992,003 | A * | 2/1991 | Perach | 405/302.7 |
| 5,326,192 | A * | 7/1994 | Freed | 47/9 |
| 5,567,087 | A * | 10/1996 | Theisen | 405/302.7 |
| 5,612,114 | A * | 3/1997 | Zalewski et al. | 428/102 |
| 5,616,399 | A * | 4/1997 | Theisen | 428/175 |
| 5,795,835 | A * | 8/1998 | Bruner et al. | 442/310 |
| 5,856,243 | A * | 1/1999 | Geirhos et al. | 442/57 |
| 6,171,022 | B1 * | 1/2001 | Decker | 405/16 |
| 6,305,875 | B1 * | 10/2001 | Matsumoto | 405/16 |
| 6,368,024 | B2 * | 4/2002 | Kittson | 405/302.7 |
| 6,429,153 | B1 * | 8/2002 | Welkers et al. | 442/35 |
| 6,477,865 | B1 | 11/2002 | Matsumoto | |
| 6,481,934 | B1 * | 11/2002 | Alexiew | 405/302.7 |
| 6,503,853 | B1 * | 1/2003 | Kassner et al. | 442/57 |
| 6,706,376 | B1 * | 3/2004 | Von Fransecky | 428/212 |
| 6,877,932 | B2 * | 4/2005 | Prevost | 405/38 |
| 7,279,436 | B2 * | 10/2007 | Pintz | 442/43 |
| 7,470,094 | B2 * | 12/2008 | Heathcott et al. | 405/302.7 |
| 7,699,949 | B2 * | 4/2010 | Newton et al. | 156/60 |
| 7,786,026 | B2 * | 8/2010 | Newton et al. | 442/2 |
| 7,820,560 | B2 * | 10/2010 | Weiser et al. | 442/32 |
| 8,043,689 | B2 | 10/2011 | Weiser | |
| 8,342,213 | B2 * | 1/2013 | Sutton et al. | 139/384 R |
| 2002/0157429 | A1 * | 10/2002 | Matsumoto | 66/195 |
| 2005/0287343 | A1 | 12/2005 | Weiser | |
| 2008/0220185 | A1 * | 9/2008 | Fan et al. | 428/17 |
| 2011/0196064 | A1 * | 8/2011 | Volkel et al. | 523/200 |

* cited by examiner

FIG. 6

Harness Weave Pattern 1. 9, 13 up
2. 10, 14 up
3. 9,11,13,14 up
4. 9,10, 12-14 up
5. 7, 9, 10, 11, 13, 14 up
6. 6, 8-14 up
7. 3, 5 ,7,9-14 up
8. 4,6-14 up
9. 3,5,7-14 up
10. 3,4,6-14 up
11. 3,4,6-14 up
12. 3,4,6-14 up
13. 3,4,5,7-14 up
14. 3,4,6-14 up
15. 3,5,7-14 up
16. 4,7-14 up
17. 3,5,7,9-14 up
18. 8-14 up
19. 7,9-11,13,14 up
20. 9,10,12,13,14 up
21. 9,11,13,14 up
22. 10,13,14 up
23. 9,13 up
24. 14 up
25. 13 up
26. 14 up
27. 14 up
28. 14 up

METHOD FOR MANUFACTURING A TURF REINFORCEMENT MAT

CROSS-REFERENCE TO RELATED APPLICATION

This application is a continuation-in-part of U.S. Non-Provisional patent application Ser. No. 12/845,234 filed Jul. 28, 2010, which in turn claims priority benefit to U.S. Provisional Patent Application Ser. No. 61/229,962 filed Jul. 30, 2009, which applications are hereby incorporated herein by reference.

TECHNICAL FIELD

The present invention relates generally to the fields of woven materials and turf management, and more particularly to a method of manufacturing fabrics for the reinforcement of natural turf.

BACKGROUND

According to the U.S. Environmental Protection Agency (EPA), high volume and high velocity storm water runoff can erode soil within the open channels, drainage ditches, and swales, and on steep exposed slopes, increasing the transport of sediments into receiving orders. Water quality impacts of increased sediment load include the conveyance of nutrient and pesticide pollutants, disruption of fish spawning, and impairment of aquatic habitat.

Traditionally, hard armor erosion control techniques such as concrete blocks, rock rip rap, and reinforced paving systems have been employed to prevent soil erosion in these highly erosive areas. Although these measures can withstand great hydraulic forces, they are costly, and they do not provide the pollutant removal capabilities of vegetative systems.

Turf reinforcement mats (TRMs) enhance the natural ability of vegetation to permanently protect soil from erosion. TRMs are composed of interwoven layers of non-degradable geo-synthetic materials such as polypropylene, nylon and polyvinyl chloride netting, stitched together to form a three-dimensional matrix. They are thick and porous enough to allow for soil filling and retention. In addition to providing its scour protection, the mesh netting of TRMs is designed to enhance vegetative root and stem development. By protecting the soil from scouring forces and enhancing vegetative growth, TRMs raise the threshold of natural vegetation to withstand higher hydraulic forces on stabilization slopes, stream banks, and channels. In addition to reducing flow velocities, the use of natural vegetation provides particulate contaminant removal through sedimentation and soil infiltration, and improves the aesthetics of the site.

TRMs offer high shear strength, resistance to ultraviolet degradation, and resistance to chemicals found in soils. TRMs, unlike temporary erosion control products, are designed to stay in place permanently to protect seeds in soils and to improve germination. TRMs can incorporate natural fiber materials to assist in establishing vegetation. However, the permanent reinforcement structure of TRMs is composed of entirely non-degradable synthetic materials. A variety of ground anchoring devices can be used to secure TRMs, including: U-shaped wire staples, metal pins, and wood or plastic stakes. Appropriate ground anchoring devices are chosen based on site-specific soil and slope conditions.

The use of TRMs allows vegetative cover to be extended to areas where site conditions would otherwise limit it. This helps to establish and maintain a continuous vegetative cover throughout the applied area. TRMs can be applied to most sites or structures where permanent erosion control is required. This technology has been effectively used in both urban and rural areas and in a variety of climactic conditions. Although most effective when used in fully vegetative areas, TRMs have been used to prevent erosion even in arid, semi-arid, and high altitude regions with limited vegetative growth. In these areas, vegetation establishment is slow or difficult, and the TRM matrix is typically filled with native soils for protection.

TRMs are being used to control erosion and stabilize soil to control runoff from land disturbing activities with steep slopes, and to prevent scouring in storm water detention ponds, water storage ponds, small open channels, drainage ditches, and runoff conveyance systems within the parking lot medians, and along stream banks and shorelines.

In addition to their use for new construction projects, TRMs have been used to retrofit existing hard armor systems. In addition to improving water quality, TRMs can provide aesthetic enhancement, especially in areas lacking vegetative growth.

TRMs provide water quality benefits by allowing the growth of vegetation in areas where impervious conveyance systems would otherwise be used. In general, the performance of TRMs is closely tied to the vegetative establishment and growth. The performance of the TRM-lined conveyance system depends on the duration of the runoff event to which it is subjected.

Known TRM materials are woven in a pattern that when exposed to heat, creates a loft or three-dimensional structure. In some instances, the loft must meet a minimum thickness specification (for example, 0.25 inch) in order to be considered a TRM. The energy required for heating the material, as well as the additional equipment required for carrying out the heating process, add considerably to the expense of the product. Also, the material typically shrinks in the lengthwise and widthwise dimensions as the fibers contract during heat-treatment process to create the loft. Thus, a loom width wider than the desired final product width is typically required.

Known TRM materials also typically include a single fiber or end at the peak and valley points of the weave pattern, and provide inadequate compression resistance for some applications.

It is to the provision of an improved TRM product and manufacturing process that the present invention is primarily directed.

SUMMARY

In example embodiments, the present invention provides a turf reinforcement mat and a method of manufacturing a turf reinforcement mat without the need for the application of heat. The particular weave pattern, tension and materials used in fabricating the material create a three-dimensional product. In example embodiments, the turf reinforcement mat has, for example, a 0.25 inch or greater loft/thickness.

In one aspect, the present invention relates to a three-dimensional turf-reinforcement fabric. The three-dimensional turf-reinforcement fabric includes a woven array of fibers comprising a first plurality of fibers arranged in a first direction and a second plurality of fibers arranged in a second direction generally perpendicular to the first direction. The woven array of fibers defines rows and columns of cells, wherein each cell comprises fiber segments of the first plurality of fibers and the second plurality of fibers being spaced at differing heights in a third direction perpendicular to the first and second directions. The three-dimensional turf-reinforcement fabric is formed without the application of heat to shrink the fibers and produce a loft.

In another aspect, the invention relates to a method of forming a three-dimensional turf-reinforcement fabric. The method includes weaving a first plurality of fibers arranged in a first direction and a second plurality of fibers arranged in a second direction generally perpendicular to the first direction into a woven array having fiber segments being spaced at differing heights in a third direction perpendicular to the first and second directions, without the application of heat to produce a loft.

In another aspect, the invention relates to a turf reinforcement mat including a weave formed of a plurality of warp fibers, a plurality of weft fibers extending generally crosswise to the warp fibers, and defining a loft thickness of at least about 0.25", wherein the loft thickness is produced without heat treatment.

In another aspect, the invention relates to a three-dimensional turf-reinforcement fabric comprising a woven array of fibers comprising a first plurality of fibers arranged in a first direction and a second plurality of fibers arranged in a second direction generally perpendicular to the first direction. The second plurality of fibers are interwoven with the first plurality of fibers to form an interlaced weave, and the woven array of fibers defines rows and columns of cells, wherein each cell comprises fiber segments of the first plurality of fibers and the second plurality of fibers being spaced at differing heights in a third direction perpendicular to the first and second directions to define crests within the woven array. At least one of the first plurality of fibers proximal at least one of the crests has an increased diameter relative to the remainder of the first plurality of fibers.

In still another aspect, the invention relates to a three-dimensional turf-reinforcement fabric comprising a woven array of fibers comprising a first plurality of warp fibers arranged in a first direction and a second plurality of weft fibers arranged in a second direction generally perpendicular to the first direction. The second plurality of weft fibers are interwoven with the first plurality of warp fibers to form an interlaced weave of warp and weft fibers, and the woven array of fibers defines rows and columns of cells, wherein each cell comprises fiber segments of the first plurality of fibers and the second plurality of fibers being spaced at differing heights in a third direction perpendicular to the first and second directions and defining a material loft. The three-dimensional turf-reinforcement fabric is formed without the application of heat to produce the loft. The three-dimensional turf-reinforcement fabric further comprises a flame retardant.

In another aspect, the invention relates to a three-dimensional turf-reinforcement fabric comprising a woven array of fibers comprising a first plurality of warp fibers arranged in a first direction and a second plurality of weft fibers arranged in a second direction generally perpendicular to the first direction. The second plurality of weft fibers are interwoven with the first plurality of warp fibers to form an interlaced weave of warp and weft fibers, and the woven array of fibers defines rows and columns of cells, wherein each cell comprises fiber segments of the first plurality of fibers and the second plurality of fibers being spaced at differing heights in a third direction perpendicular to the first and second directions and defining a material loft. The three-dimensional turf-reinforcement fabric is formed without the application of heat to produce the loft. The three-dimensional turf-reinforcement fabric further comprises a UV stabilizer.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWINGS

FIG. 6 is a harness draw graph showing a harness setup for an example embodiment of the turf reinforcement mat according to the present invention.

DETAILED DESCRIPTION OF EXAMPLE EMBODIMENTS

Figure 1:
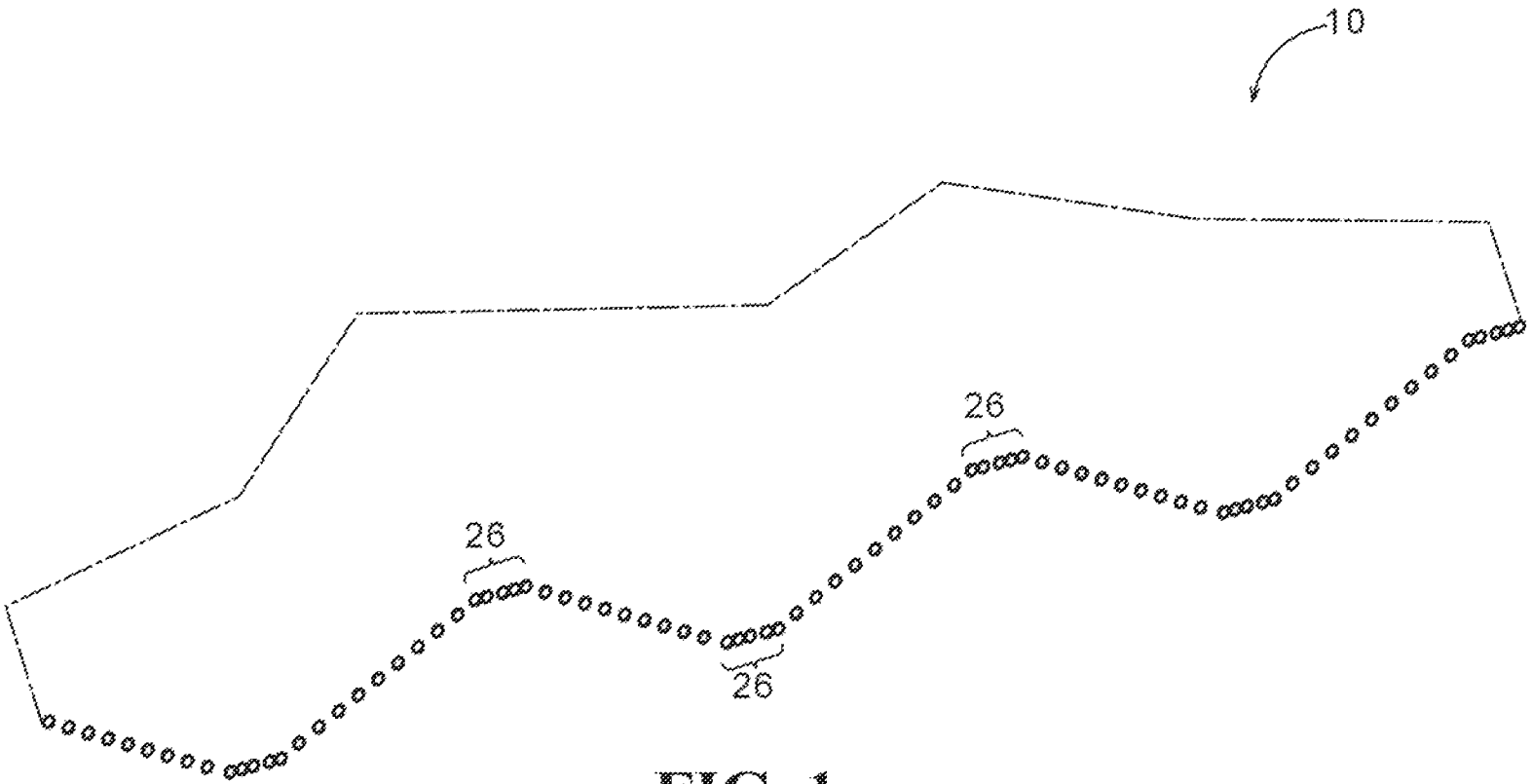
FIG. 1 is a perspective view showing the end profile of a turf reinforcement mat according to an example embodiment of the present invention.
Figure 2:
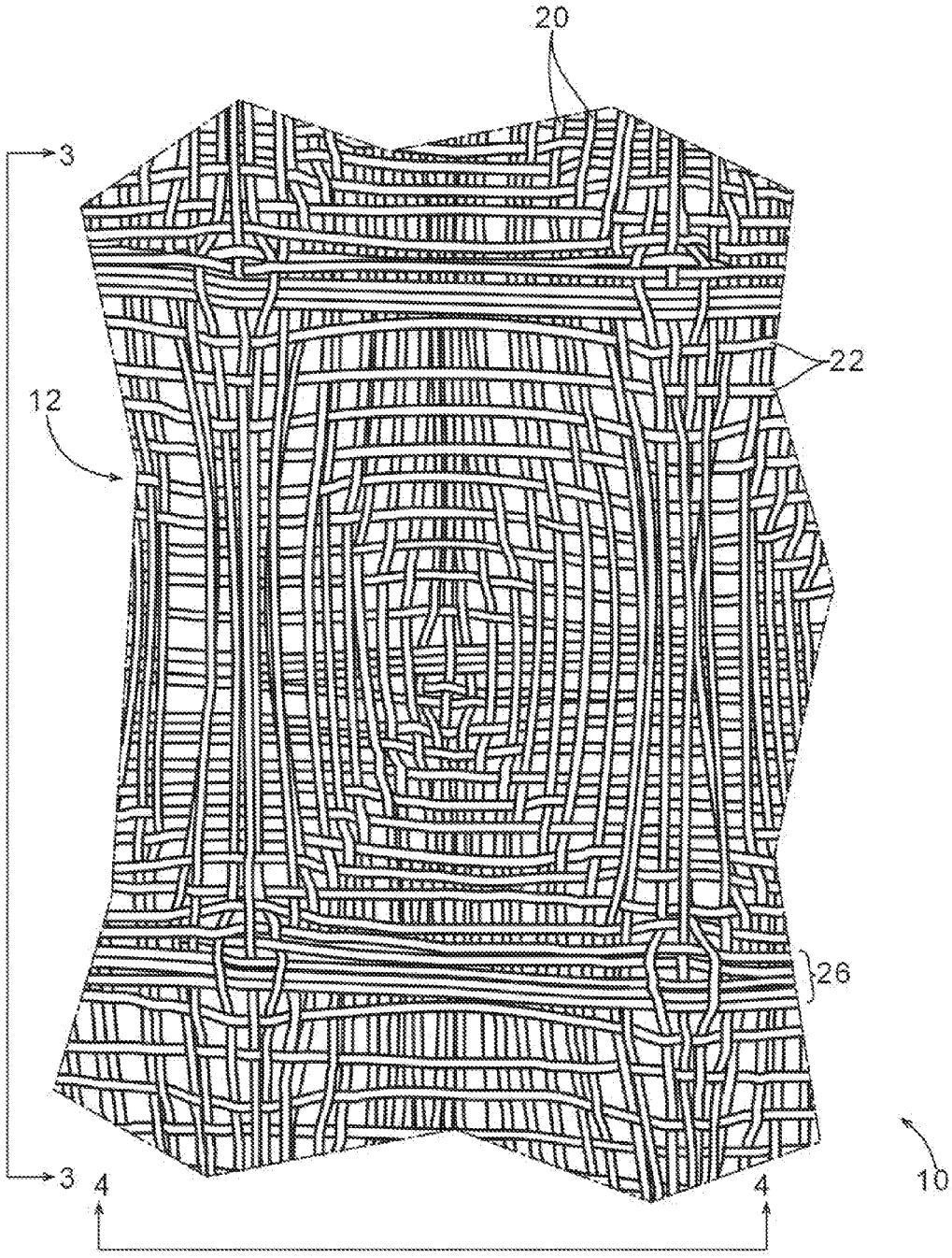
FIG. 2 is a plan view of a section of the turf reinforcement mat shown in FIG. 1.
Figure 3:
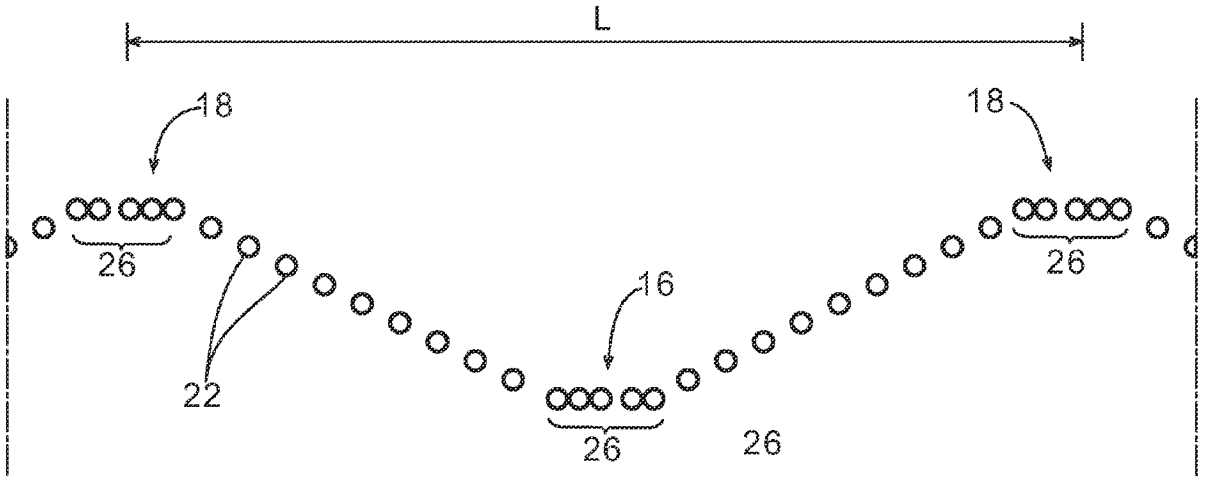
FIG. 3 is a side view in the machine direction showing the end pattern of the turf reinforcement mat shown in FIG. 1.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

In an example form, a manufacturing process according to the present invention creates a turf reinforcement mat or three-dimensional geotextile fabric without the need for the application of heat during the manufacturing process, to produce a woven material having a three-dimensional lofted profile. For example, by selective application of tension in the weaving process and/or control of the weave and fiber arrangement of the product, it has been discovered that a three-dimensional lofted profile can be formed, without the need for application of heat to generate the material's loft. In example embodiments, the material has a thickness or loft of about 0.25 inch or more.

Various types of natural and synthetic yarns can be used to weave the turf reinforcement mat of the present invention, including but not limited to polyethylene, nylon, polyester, PVC, polypropylene, etc. In an example embodiment, the yarn is polypropylene. A monofilament, multi-filament, fibrillated tape or slit tape yarn in various yarn sizes, for example from 400 denier to 3000 denier, can be used to produce a turf reinforcement mat according to the present invention. In an example embodiment, a monofilament having a yarn size of 1675 denier is utilized. The denier of the yarn and the draw ratio used in extruding the yarn provide rigidity to retain loft thickness. An example range of draw ratio is between about 5:0:1 to about 9:0:1 and the value depends upon the yarn denier and required strength. A particular example draw ratio used is 6:0:1. The yarn can be UV stabilized during manufacturing. Coloring is optionally added to the yarn during the extrusion process.

Beams can be made with either direct or sectional warping machines. The number of beam ends is determined by the width of the fabric in conjunction with the machine direction construction on the final fabric. Machine direction construction is determined by the reed that will be used on the loom in the weaving process. The beaming process can be eliminated if a creel is available to be placed behind the loom and weave directly off the yarn packages.

Different weave patterns can be generated on a loom to weave a turf reinforcement mat within the scope of the invention. One example of a weave used is a honeycomb pattern, for example as shown in FIGS. 1-4. An alternative pattern is a tubular weave. The loft and strength of the fabric can be altered and achieved through the use of a variety of yarn sizes and configurations. The size of the yarns used in conjunction with the TRM construction and weave determines the amount of loft as well as the strength of the fabric. Certain strength requirements may be desirable, depending on the intended application of the turf reinforcement mat. The construction and yarn size is modified to decrease or increase the tensile strength of the fabric to meet the requirements. The fabric is of sufficient density to stabilize the soil while still allowing vegetation to grow through the mat. Alternative uses of the material include air filtration and fuel-cell baffles. A mechanical or computer-controlled dobby head is used on the loom to achieve the required weave configuration.

Figure 5:
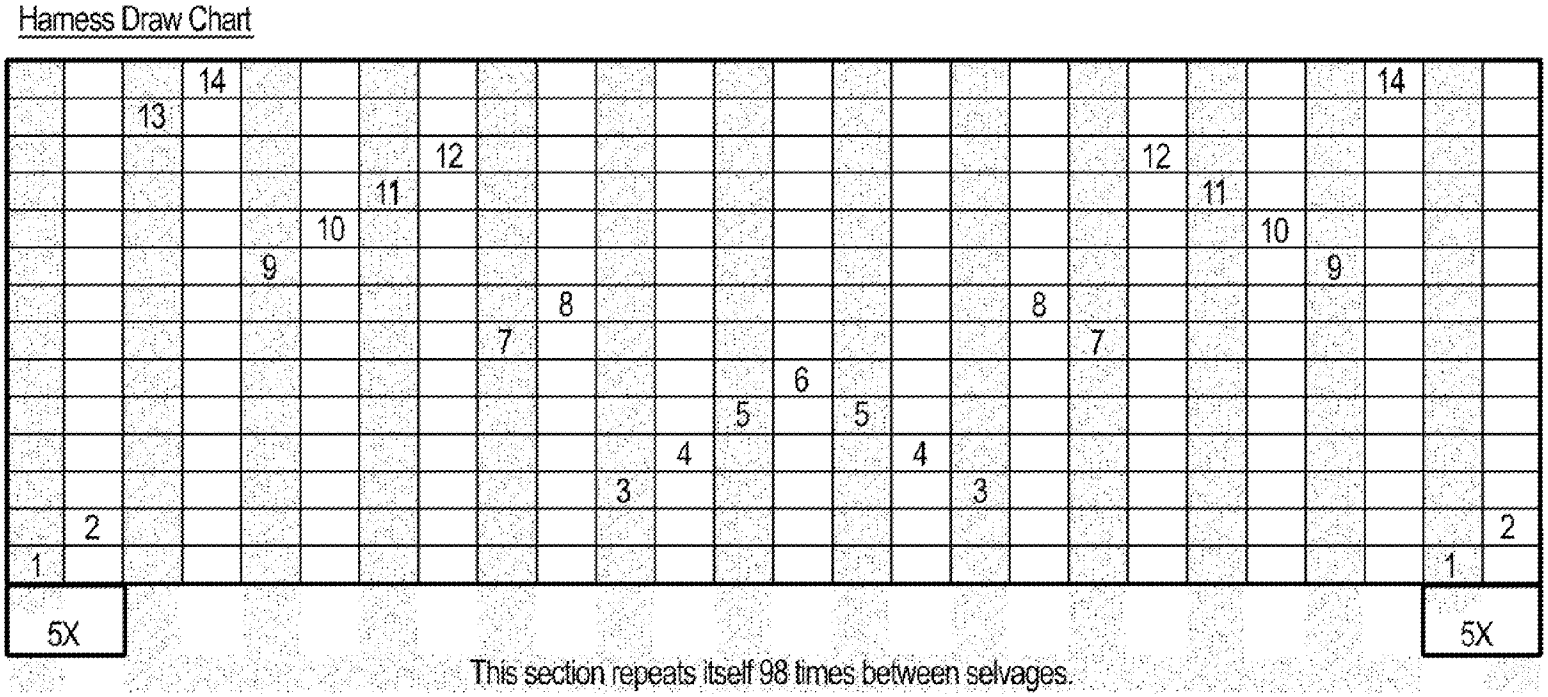
FIG. 5 is a chart of the harness pattern for the weave of the reinforcement mat shown in FIG. 1.

In the example embodiment, the loom setting has a worm gear let-off range of either 3:38 or 2:39 which can be based on the type of mechanical or electronic let-off used on the loom. In conjunction with projectile looms the whip roll setting is in the front position. An example honeycomb weave can be woven on a range of between about 8 and 18 harnesses. The example embodiment honeycomb is woven on 14 harnesses. FIG. 6 shows a harness weave pattern and FIG. 5 shows a draw graph of the weave pattern according to an example form of the invention. The example embodiment uses a reed on the loom to determine the construction of the fabric by either drawing the ends through the reed dents in one or multiple ends per dent. The example embodiment uses a 23.0 dent per inch reed and the ends are drawn 1 per dent. When coupled with the proper tension settings, the ends per inch, in conjunction with weaving the pick construction into the fabric, provide the appropriate material construction to achieve a desired three-dimensional fabric loft (i.e., the thickness between the top and bottom faces of the material) without the necessity for subsequent heat shrink.

FIGS. 1-4 show an example embodiment of a turf reinforcement material 10 with a honeycomb pattern. The honeycomb pattern is comprised of numerous box-shaped cells or volumes 12, shown in example form in detail in FIG. 2. Each box shaped cell 12 has four sides defining a length L and a width W. The example embodiment has sides defining a width of about 1" and a length of about 1.5", but in alternate forms may vary in length from about 0.5 inch to about 1.5 inches. However, additional sizes outside of this range are within the scope of the invention. Each box shaped cell 12 has a low center or valley 16 in the middle of each of the four sides, and raised corners or peaks 18 at the intersections of the sides of the cell. Each box shaped cell 12 has angled walls from the sides to the center 16, and each angled wall has a triangular shape. Otherwise described, each cell of the matrix of cells in the pattern defines an alternating and repeating upright and inverted pyramid-shaped profile formed by the intersections of the fibers within the weave.

Figure 4:
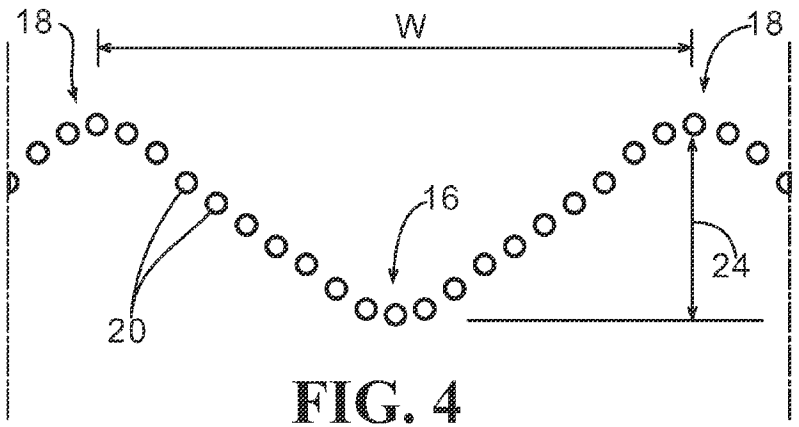
FIG. 4 is a side view in the cross-wise direction showing the end pattern of the turf reinforcement mat shown in FIG. 1.

Each box shaped cell 12 is created by weaving warp (machine direction) 20 and weft or fill (cross-machine direction) 22 filaments in a perpendicular weave pattern and manner with respect to each other. At the peaks and valleys 16 of each box shaped cell 12, a plurality of fill filaments 22 are set on top of a central warp filament 20 in perpendicular or crosswise relation with respect to each other, forming alternating upper and lower crests (e.g., ridges and valleys in at least one of the warp and/or weft filament patterns) in the machine and cross-machine directions. Provision of a plurality of fill filaments 26 at the crests provides increased resistance to compression of the material in use. In the depicted embodiment, three crest filaments 26 are utilized, but in alternate embodiments, one, two or more than three crest filaments are provided. Also, while the depicted embodiment provides multiple crest filaments 26 in the fill direction, alternate embodiments may comprise multiple crest filaments in the warp direction or in both the warp and fill directions at the peak and/or valley boundaries of each cell 12 of the turf reinforcement material 10. Two horizontal filaments are then set on top of the vertical filament on either side of the central horizontal filament and each parallel to the central horizontal filament. Two vertical filaments are then set on top of the horizontal filaments on either side of the central horizontal filaments and parallel to the central horizontal filament. This process is repeated with further horizontal filaments extending further from, and parallel to, the central horizontal filament and with further vertical filaments extending further from, and parallel to, the central vertical filament, until the height 24 from the center 16 to each corner is at least about 0.25 inches as shown in FIG. 4. The number of filaments can vary depending on the thickness of each filament and the distance between the parallel filaments. The final vertical and horizontal filaments applied to the honeycomb pattern define the sides of each box shaped cell 12. An example embodiment has about twenty-four warp filaments 20 and twenty weft filaments 22 per box shaped cell 12. In alternate embodiments, more or fewer filaments per cell are provided.

In the example embodiment, each filament has the same tensioning level and warp level, and the same yarn stiffness and denier. In alternate embodiments, varying tensioning, warp level and/or yarn characteristics are within the scope of the invention. The harness operation is preferably automatically controlled, for example by electronic or punch card programming. FIG. 5 is a harness draw graph for setting up the loom harnesses to generate the three-dimensional basket-weave pattern of the depicted example. FIG. 6 is a harness weave pattern chart showing the harness positions at sequential shuttle passes during the weave process. Yarns of a specified stiffness and denier are drawn in through the harnesses and reed per the draw graph, the harnesses are installed onto the loom, and the loom is operated in typical fashion to produce the TRM material. The weave pattern and manufacturing method result in a three-dimensional TRM material having a thickness or loft substantially greater than the fiber thickness, and preferably at least about 0.25 inches, as seen best with reference to FIG. 3, without the need for application of heat to produce the loft.

Figure 7:
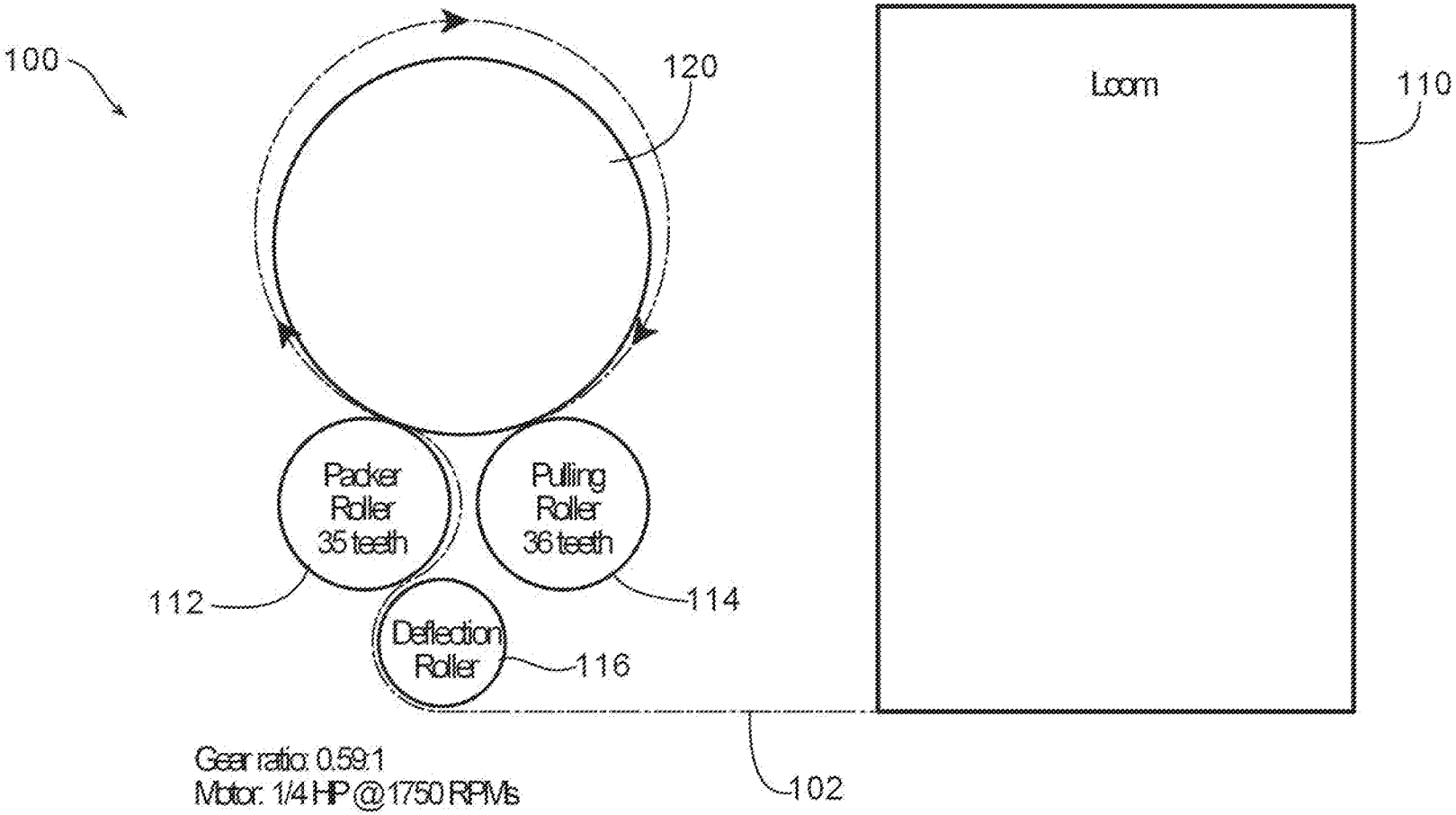
FIG. 7 is a schematic view of a loom and take-up roller tensioning system for producing a reinforcement mat according to an example form of the invention.

FIG. 7 shows a tension roller system 100 for tensioning the turf reinforcement mat 102 as it is drawn off the loom 110. A packer roller 112 and a pulling roller 114 are driven by a motor via a chain and sprocket drive, with the tooth ratio of the rollers selected as shown to apply tension as the turf reinforcement mat is collected in a product roll 120. A deflection roller 116 directs the mat 102 from the loom 110 to the packer roller 112.

Figure 8:
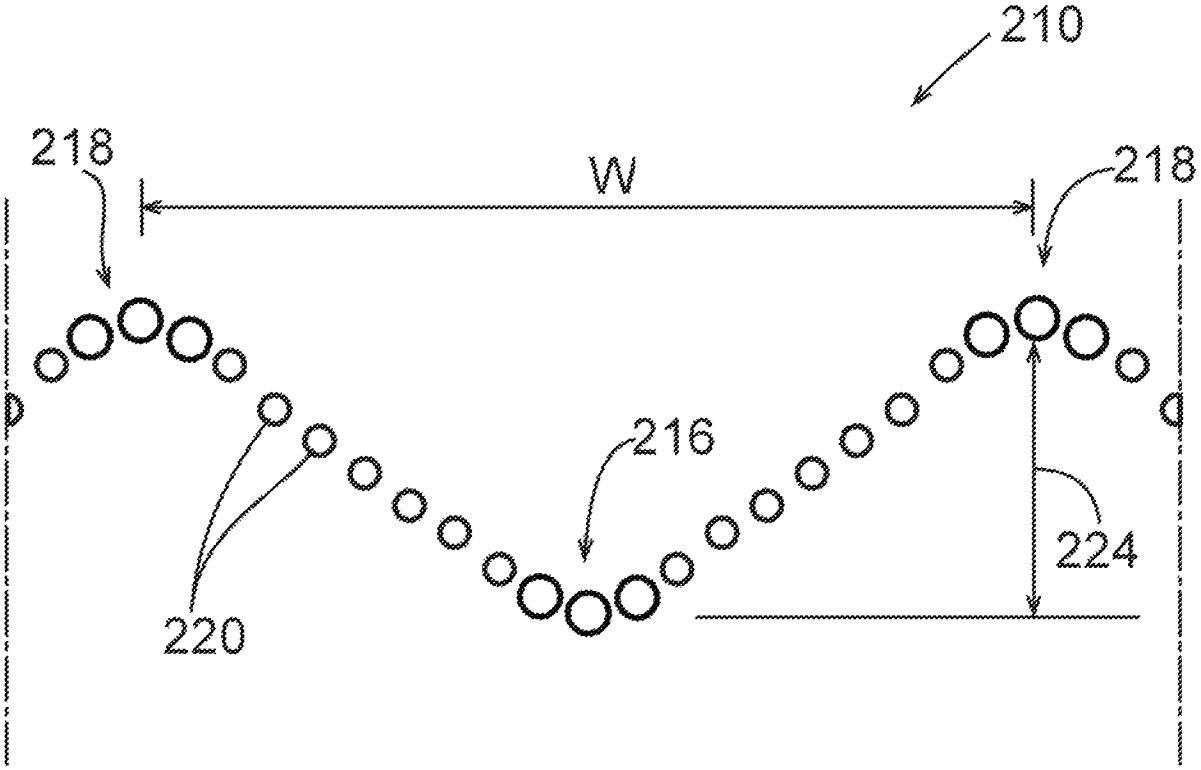
FIG. 8 is a cross-sectional fiber view of a turf reinforcement mat according to another example embodiment of the present invention, having thicker crest fibers.

FIG. 8 shows an alternative embodiment of a turf reinforcement mat 210 wherein one or more warp (machine direction) fibers at the valleys and/or peaks (or lower and upper crests) 216, 218 of the material are of increased thickness (e.g., about 5% to 25% greater diameter) relative to the other fibers of the mat, to provide for additional loft, rigidity and/or strength. For example, at least one of the machine direction fibers at and/or adjacent the crests 216, 218 (in the depicted embodiment three increased thickness fibers are included in the vicinity of each crest, one at the crest and one on either side thereof) are 25 mil yarns (e.g., 2560 denier), which have about a 19% greater diameter than the 1675 denier fibers of the remainder of the mat. The increased diameter fibers provide additional loft 224 by providing more rigidity in the machine direction while the fabric is being pulled on the take-up (e.g., collected in the product roll).

In further example embodiments, a flame retardant material optionally can be incorporated into the fabric. Preferably, the treated fabric can pass the NFPA (i.e., National Fire Protection Association) 701 testing procedure and still meet an 80% tensile retention at at least about 2500 hours, or more preferably at about 3000 hours, per ASTM D4355 xenon arc UV exposure (a test by the American Society for Testing and Materials that covers the determination of the deterioration in tensile strength of geotextiles by exposure to xenon arc radiation, moisture, and heat), and meet a strength specification, for example, of 4000 lbs.×3000 lbs. Alternatively or additionally, the treated material meets the requirements of one or more flame retardant testing standards such as for example Federal MIL STD 191A Method 5903.1 Vertical flame test; NFPA 701 Vertical Flame Test; and/or ASTM D6413 Vertical Flame Test of Textiles (Test Method D6413 has been adopted from Federal Test Standard No. 191A method 5903.1). In one form, a brominated flame retardant (i.e., organobromide compounds) is added to the yarn during the extrusion process. For example, in example embodiments, about 3-9% of the fibers' material content comprises the flame retardant. In alternate embodiments, other flame retardant additives may be incorporated, in greater or lesser percentage of fiber content, such as for example a combination flame retardant and hindered amine light stabilizer (HALS) such as BASF Flamestab™ NOR 116 (a monomeric N-alkoxy hindered amine), or a bromine-based flame retardant, optionally in combination with a HALS UV stabilizer.

In further embodiments, the material additionally or alternatively comprises a UV (ultraviolet) stabilizer to provide the mat with resistance to UV degradation from sunlight exposure. For example, some or all of the fibers of the mat can be extruded from a polypropylene base material and include a carbon black additive having a particle size of about 19 nanometers. Alternatively or additionally, a hindered amine light stabilizer (HALS) may be used for UV stabilization.

While the invention has been described with reference to preferred and example embodiments, it will be understood by those skilled in the art that a variety of modifications, additions and deletions are within the scope of the invention, as defined by the following claims.

What is claimed is:

1. A three-dimensional turf-reinforcement fabric comprising a woven array of fibers comprising a first plurality of fibers arranged in a first direction and a second plurality of fibers arranged in a second direction generally perpendicular to the first direction, wherein the second plurality of fibers are interwoven with the first plurality of fibers to form an interlaced weave, the woven array of fibers defining rows and columns of cells, wherein each cell comprises fiber segments of the first plurality of fibers and the second plurality of fibers being spaced at differing heights in a third direction perpendicular to the first and second directions to define crests within the woven array, and wherein at least one of the first plurality of fibers proximal at least one of the crests has an increased diameter relative to the remainder of the first plurality of fibers.

2. The three-dimensional turf-reinforcement fabric of claim 1, wherein at least one of the first plurality of fibers proximal each of the crests has an increased diameter relative to the remainder of the first plurality of fibers.

3. The three-dimensional turf-reinforcement fabric of claim 1, wherein a plurality of the first plurality of fibers proximal each of the crests have an increased diameter relative to the remainder of the first plurality of fibers.

4. The three-dimensional turf-reinforcement fabric of claim 1, wherein the woven array of fibers comprises a tubular or honeycomb pattern.

5. The three-dimensional turf-reinforcement fabric of claim 1, wherein the fibers are selected from polypropylene, polyethylene, nylon, polyester, PVC, other natural or synthetic fibers, and combinations thereof.

6. The three-dimensional turf-reinforcement fabric of claim 5, wherein the fibers further comprise a flame retardant.

7. The three-dimensional turf-reinforcement fabric of claim 5, wherein the fibers further comprise a UV resistant additive.

8. The three-dimensional turf-reinforcement fabric of claim 7, wherein the UV resistant additive comprises carbon black.

9. The three-dimensional turf-reinforcement fabric of claim 1, wherein the loft of the fabric is produced by control of at least one of the following parameters: loom tension setting, ends per inch of the weave, and weaving the pick construction into the fabric.

10. The three-dimensional turf-reinforcement fabric of claim 1, wherein the spacing of fibers at differing heights in the third direction perpendicular to the first and second directions at the crests defines a loft of at least about 0.25".

11. The three-dimensional turf-reinforcement fabric of claim 1, wherein the three-dimensional turf-reinforcement fabric is formed without the application of heat to produce a loft.

12. The three-dimensional turf-reinforcement fabric of claim 1, wherein the at least one increased diameter fiber has a fiber diameter at least about 5% greater than the remainder of the first plurality of fibers.

13. The three-dimensional turf-reinforcement fabric of claim 1, wherein the at least one increased diameter fiber has a fiber diameter of between 5%-25% greater than the remainder of the first plurality of fibers.

14. The three-dimensional turf-reinforcement fabric of claim 1, wherein the at least one increased diameter fiber has a fiber diameter of about 20% greater than the remainder of the first plurality of fibers.

15. The three-dimensional turf-reinforcement fabric of claim 1, wherein the first plurality of fibers are warp fibers arranged in a machine direction of a loom during production, and the second plurality of fibers are weft fibers interwoven with the warp fibers.

16. A three-dimensional turf-reinforcement fabric comprising a woven array of fibers comprising a first plurality of warp fibers arranged in a first direction and a second plurality of weft fibers arranged in a second direction generally perpendicular to the first direction, wherein the second plurality of weft fibers are interwoven with the first plurality of warp fibers to form an interlaced weave of warp and weft fibers, the woven array of fibers defining rows and columns of cells, wherein each cell comprises fiber segments of the first plurality of fibers and the second plurality of fibers being spaced at differing heights in a third direction perpendicular to the first and second directions and defining a material loft, wherein the three-dimensional turf-reinforcement fabric is formed without the application of heat to produce the loft, the three-dimensional turf-reinforcement fabric further comprising a flame retardant.

17. The three-dimensional turf-reinforcement fabric of claim 16, wherein the flame retardant comprises a brominated flame retardant.

18. The three-dimensional turf-reinforcement fabric of claim 16, wherein the flame retardant comprises about 3-9% material content of the fibers.

19. A three-dimensional turf-reinforcement fabric comprising a woven array of fibers comprising a first plurality of warp fibers arranged in a first direction and a second plurality of weft fibers arranged in a second direction generally perpendicular to the first direction, wherein the second plurality of weft fibers are interwoven with the first plurality of warp fibers to form an interlaced weave of warp and weft fibers, the woven array of fibers defining rows and columns of cells, wherein each cell comprises fiber segments of the first plurality of fibers and the second plurality of fibers being spaced at differing heights in a third direction perpendicular to the first and second directions and defining a material loft, wherein the three-dimensional turf-reinforcement fabric is formed without the application of heat to produce the loft, the three-dimensional turf-reinforcement fabric further comprising a UV stabilizer.

20. The three-dimensional turf-reinforcement fabric of claim 19, wherein the UV stabilizer comprises carbon black.

21. The three-dimensional turf-reinforcement fabric of claim 20, wherein the carbon black comprises particles of about 19 nanometers.

22. The three-dimensional turf-reinforcement fabric of claim 19, wherein the UV stabilizer comprises a hindered amine light stabilizer (HALS).

* * * * *